United States Patent [19]

Halstensgaard et al.

[11] Patent Number: 4,583,760

[45] Date of Patent: Apr. 22, 1986

[54] VEHICLE STABILIZER ATTACHMENT AND METHOD

[75] Inventors: Gaylen E. Halstensgaard, Milnor; John W. Henline; Orlan J. Loraas, both of Lisbon, all of N. Dak.

[73] Assignee: Clark Equipment Company, Buchanan, Mich.

[21] Appl. No.: 647,006

[22] Filed: Sep. 4, 1984

[51] Int. Cl.[4] ..... B66B 9/20

[52] U.S. Cl. ..... 280/766.1

[58] Field of Search ..... 280/766.1, 763.1, 764.1; 212/189, 264, 265

[56] References Cited

U.S. PATENT DOCUMENTS

| | | | |
|---|---|---|---|
| 3,079,009 | 2/1963 | Davis | 280/766.1 |
| 3,438,509 | 4/1969 | Munz | 280/766.1 |
| 3,630,317 | 12/1971 | Jacobsson | 187/9 R |
| 4,018,458 | 4/1977 | Shumaker | 280/766 |
| 4,082,197 | 4/1978 | Stedman | 414/687 |
| 4,461,490 | 7/1984 | Fritel et al. | 280/766.1 |

FOREIGN PATENT DOCUMENTS 77009025 1/1977 Sweden .

*Primary Examiner*—Richard A. Bertsch

*Attorney, Agent, or Firm*—Kenneth C. Witt; John C. Wiessler

[57] ABSTRACT

A stabilizer attachment for a work vehicle. The attachment is linear in operation and when it is attached adjacent one end of a vehicle and is then extended it raises the adjacent wheel off the ground. Another stabilizer attachment on the other side of the vehicle when operated raises the corresponding wheel on the other side off the ground. With the two wheels off the ground more down pressure is exerted on a ground engaging implement and the stabilizers act as a brake securing the work vehicle in position during operation of the implement.

10 Claims, 11 Drawing Figures

VEHICLE STABILIZER ATTACHMENT AND METHOD

BACKGROUND OF THE INVENTION

1. Field of the Invention

This invention relates to an extendible and tractable linear stabilizer which is readily attached to and detached from the frame of a work vehicle. Usually such stabilizers operate in pairs, and when the stabilizers are extended more down pressure can be exerted on a ground engaging implement carried by the vehicle and the stabilizers act as a brake holding the work vehicle in position during operation of the implement.

2. Description of the Prior Art:

U.S. Pat. No. 3,630,317 Jacobsson shows two hydraulically operated stabilizers on a three-wheel fork truck which stabilizers are automatically actuated when the load carriage of the vehicle is raised.

U.S. Pat. No. 4,018,458 Shumaker shows a stabilizer for a vehicle which consists of a pair of telescopic members with one member being mounted on the vehicle and the other member having a ground engaging foot supported on the free end thereof for rotation in a horizontal plane. The stabilizer incorporates latch means between the telescopic member and the foot for holding the foot in a plurality of rotated positions with respect to the telescopic member, whereby the angular position of maximum stability for the vehicle can be varied.

U.S. Pat. No. 4,082,197 Stedman shows an articulated vehicle having rear and front frames pivotally connected together and a pair of steering cylinders pivotally connected between the rear and front frames for pivoting them relative to each other. A telescopic boom is pivotally mounted on the rear frame and has a work implement, such as a fork, attached to the end of the boom. A pair of lift cylinders are pivotally connected to opposite sides of the front frame and to a ground engaging plate or plates. The lift cylinders are extended to engage the plate or plates with the ground to lift the rear frame relative to the front frame while simultaneously maintaining the front frame in contact with the ground. Upon alternate extension and retraction of the steering cylinders, the rear frame pivots (slues) relative to the front frame to place the work implement into an infinite number of work positions.

Swedish patent No. 7700902-5 shows a vehicle having two pivotally mounted wheels adjacent one end of the vehicle which are operated to be raised and lowered by a pair of hydraulic cylinders. The two hydraulic cylinders are operated jointly by a hydraulic valve having raise and lower positions and an intermediate neutral position. When the valve is in neutral a hydraulic connection between the head ends of the two cylinders and another hydraulic connection between the rod ends of the two cylinders permit hydraulic fluid to circulate between the two cylinders to allow the pivotally mounted wheels to adjust to different heights to accommodate the wheels and vehicle to uneven terrain.

In addition to the foregoing patented prior art there is unpatented prior art which is discussed in detail hereinafter.

SUMMARY OF THE INVENTION

In the present invention a structure and method provide for readily attaching a linear stabilizer attachment to a vehicle and readily detaching it again. The attachment is secured to the vehicle frame by a latch mechanism adjacent one end of the attachment and another connection at the other end of the attachment. The stabilizer attachment is telescopic and is extended and retracted by an internal hydraulic cylinder; hydraulic hoses from such cylinder are connected to hydraulic hoses on the vehicle.

When two of these stabilizers are used together the stabilizer cylinders are connected together hydraulically so when the stabilizer control valve is actuated both stabilizers extend and retract together. Because of the hydraulic connections the stabilizers automatically compensate for uneven terrain on tilt of the work vehicle, so that both of the stabilizers remain in contact with the ground when extended.

DESCRIPTION OF THE PREFERRED EMBODIMENT

Figure 1:
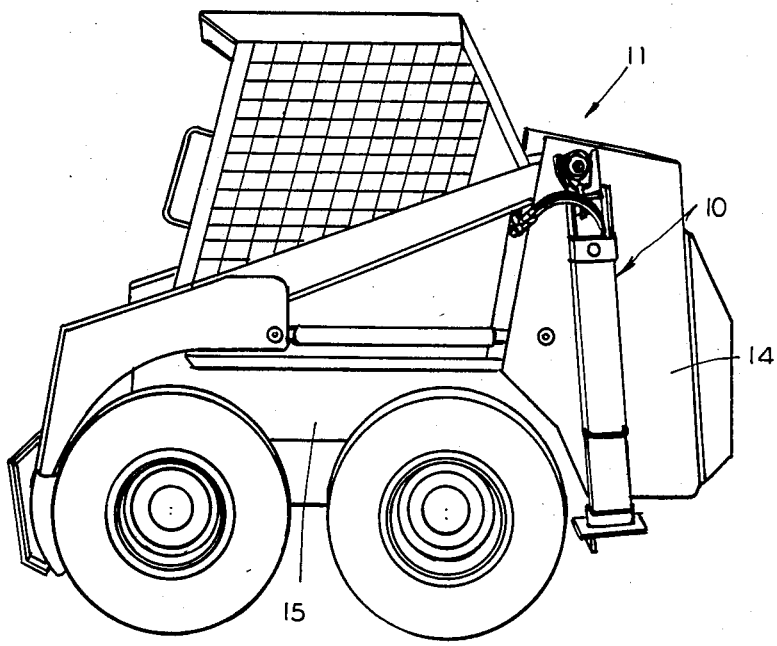
FIG. 1 is a profile view of a vehicle embodying this invention.
Figure 2:
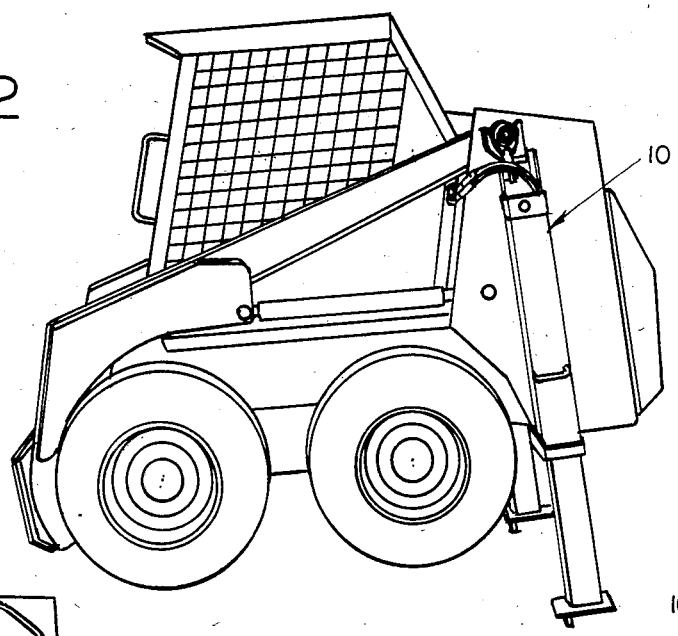
FIG. 2 is a view of the same vehicle with the near stabilizer extended.
Figure 3:
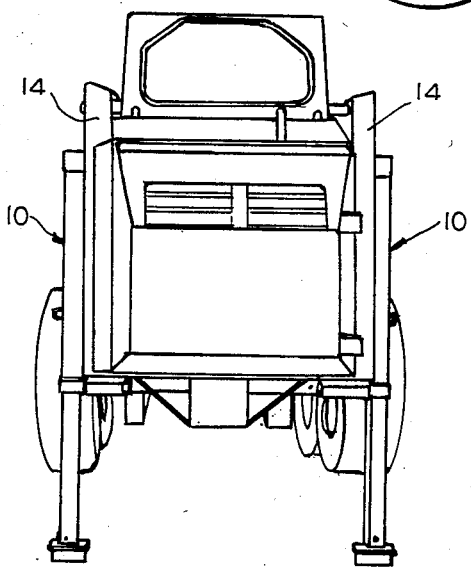
FIG. 3 shows a rear view of the same vehicle which employs two of the stabilizer attachments according to the present invention, one on each side.
Figure 4:
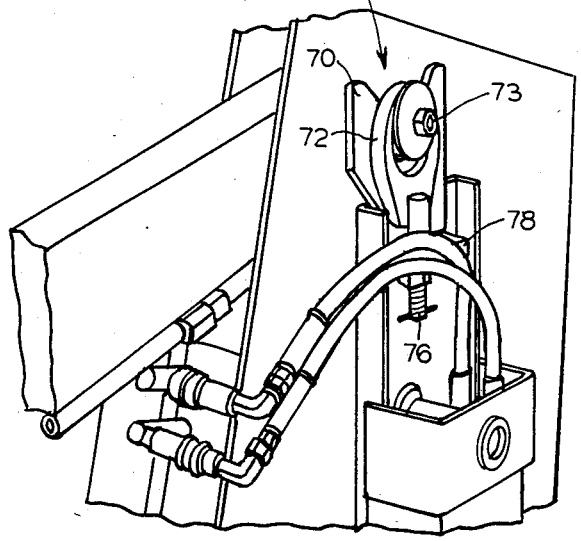
FIG. 4 shows a partial perspective view of the upper end of a stabilizer.

FIG. 1 of the drawing shows a detachable stabilizer 10 according to the present invention for a vehicle 11. It is connected to the upright or stanchion portion 14 of the vehicle frame 15. FIG. 2 of the drawing is the same as FIG. 1 except that the near stabilizer 10 is extended. FIG. 3 is a rear view of the same vehicle 11 showing two stabilizers adjacent opposite sides respectively, both of which have been extended. FIG. 4 is a partial perspective view of the upper end of stabilizer 10.

Figure 5:
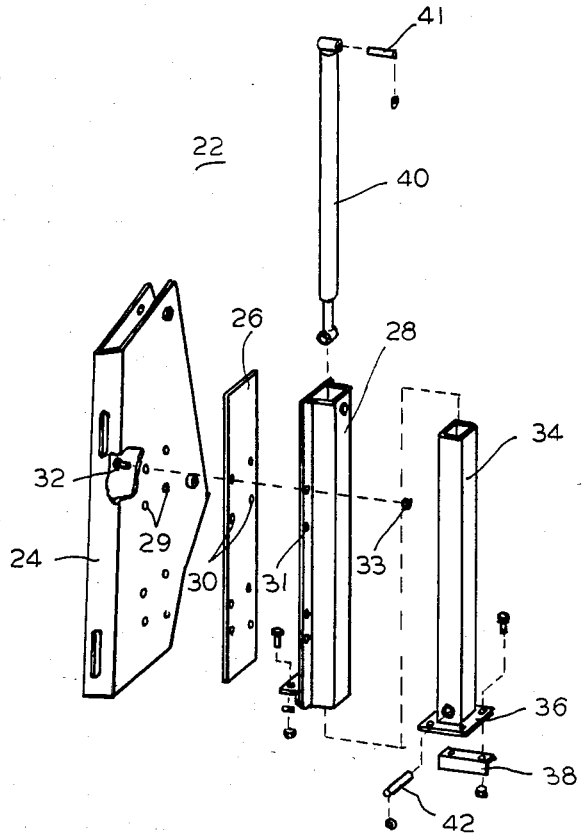
FIG. 5 PRIOR ART
FIG. 5 shows an exploded view of a prior art construction.
Figure 6:
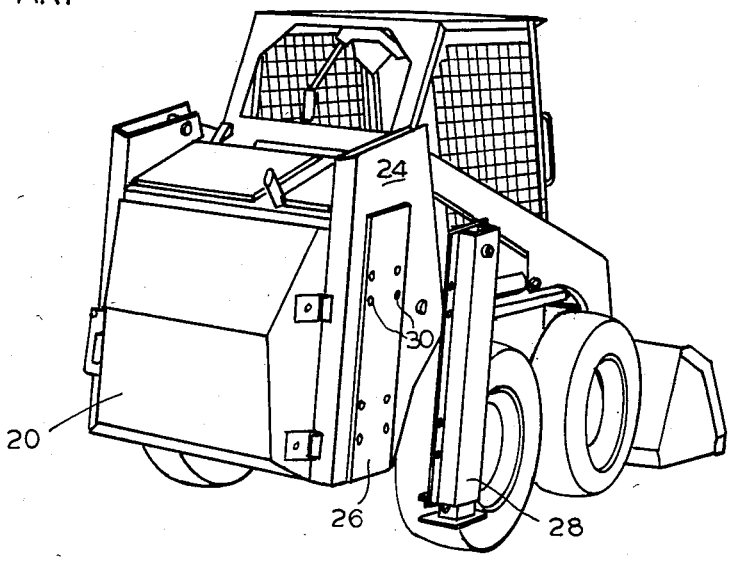
FIG. 6 PRIOR ART
FIG. 6 shows how the prior art construction is assembled on a vehicle.

In FIGS. 5 and 6 a prior art stabilizer is indicated by the numeral 22 and the vehicle is indicated by the numeral 20 in FIG. 6; both views are perspective views from the right rear as compared to the left side perspective views of FIGS. 1 and 2.

Included in FIG. 5 is a stanchion member 24 which is a part of the frame of the vehicle 20, and a plate 26 which is secured between channel member 28 and stanchion member 24 by means of bolts 32 and nuts 33 and a plurality of holes 29, 30 and 31. The tube formed by members 26,28 is the outer structure of the stabilizer and it contains within it an inner telescopically movable member 34. Member 34 has at the bottom a ground engaging flange 36 and a cleat 38 secured to the flange 36. The stabilizer 22 is operated by means of an internal hydraulic cylinder 40 which extends between a crosspin 41 at the top of housing 28 and a pin 42 at the bottom which extends through the inner slide member 34.

Figure 7:
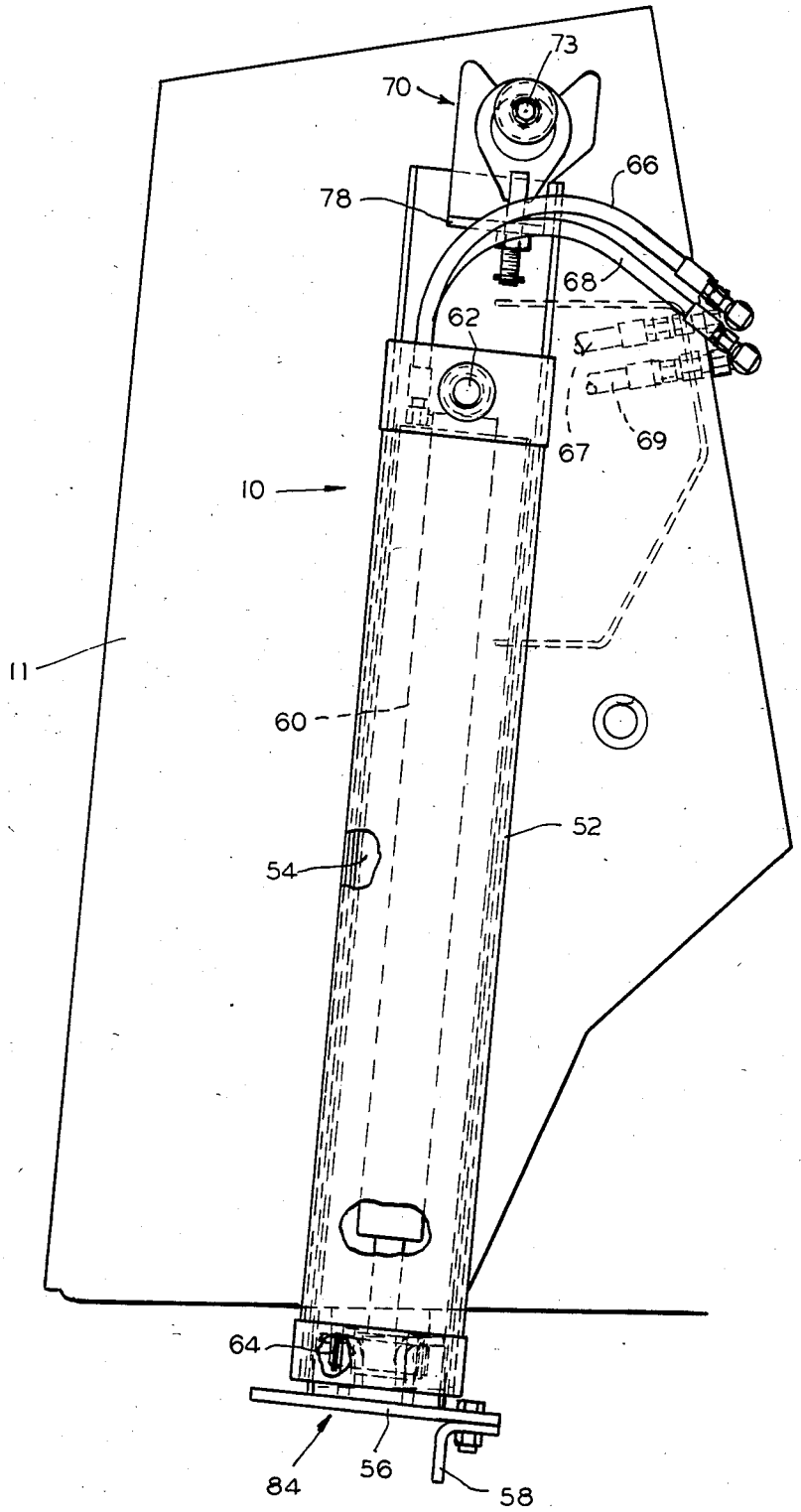
FIG. 7 is a view of the stabilizer of the present invention.

FIG. 7 of the drawing shows a stabilizer attachment 10 according to the present invention. It is on the right side of the vehicle and thus is the mirror image of the one appearing in FIG. 1 of the drawing. It includes an outer tubular member 52 of generally square cross-section, and an inner telescopic tubular member 54. Base 56 with cleat 58 thereon is secured to the lower extremity of member 54. A hydraulic cylinder 60 inside the stabilizer structure is connected between a pin 62 near the top of outer member 52 and inner member 54 at the bottom where the connecting pin is indicated by the numeral 64. The stabilizer can be retracted or extended as illustrated in FIGS. 1 and 2 by the operation of hydraulic cylinder 60; it is supplied with pressurized hydraulic fluid for double acting operation through hoses 66 and 68.

Figure 8:
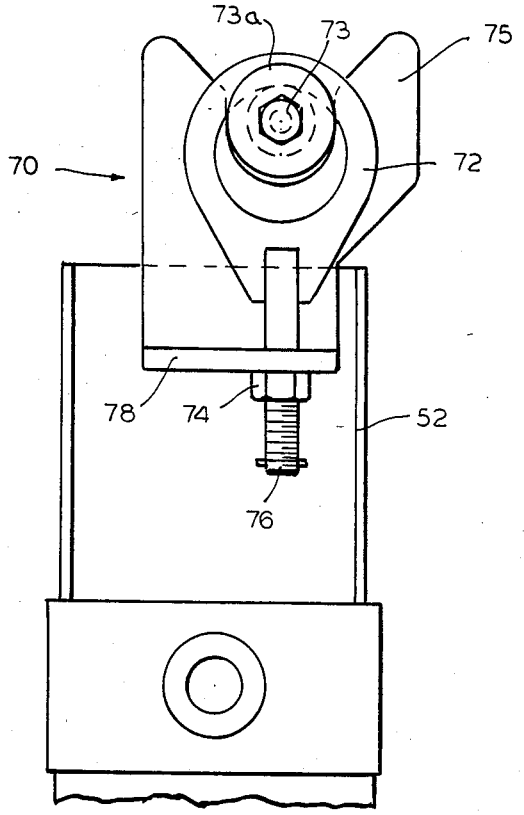
FIG. 8 is a partial view of the stabilizer of this invention.
Figure 9:
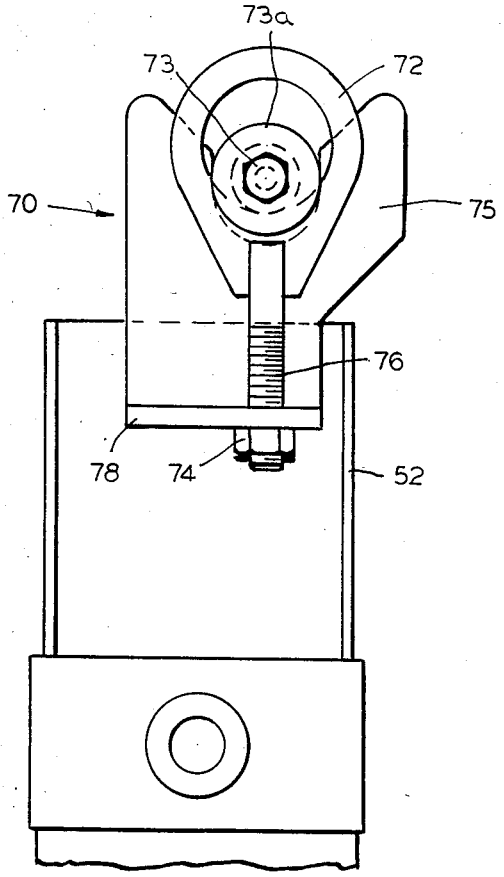
FIG. 9 is another view of the same stabilizer.
Figure 10:
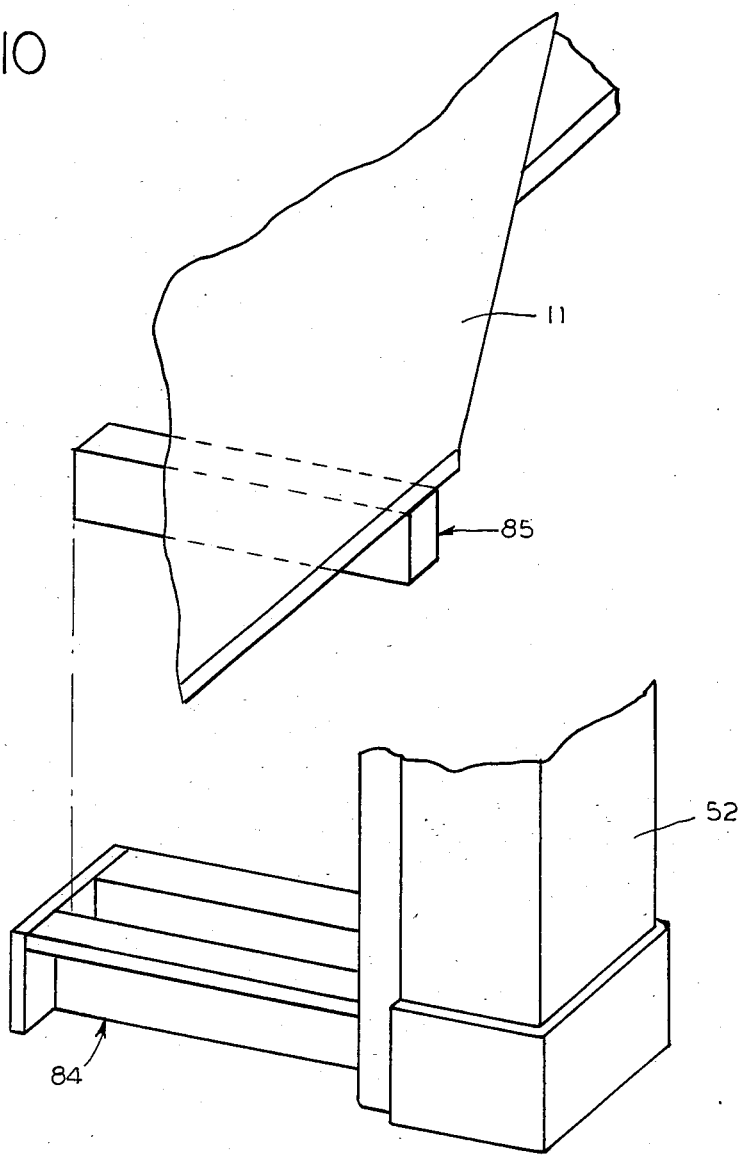
FIG. 10 is a fragmentary diagram illustrating the lower connection of a stabilizer with the frame of a vehicle.

In order to install a stabilizer 10 on the vehicle 11 the connection mechanism indicated generally by the numeral 70 at the top of the stabilizer is utilized. As shown in FIG. 9 the mechanism 70 has an extended unlatched position wherein the outer tube 52 is lowered with respect to a hanger 72 by turning nut 74 downwardly to the position indicated in FIG. 9. The stud bolt 76 is connected to hanger 72. Bracket 78, which rests on nut 74, is secured to outer tube 52. To install this stabilizer on the machine the hanger 72, as it appears in FIG. 9, is hung over a boss 73 which projects outwardly from the frame 15 of the vehicle. Then, the nut 74 is turned to raise the flange 78 which is connected to outer tube 52 to the raised position as shown in FIG. 8 wherein the stabilizer is firmly secured to the vehicle. This is because hanger 72 is restrained from movement by being between flange *73a* on boss 73 and a bracket 75 at the top end of outer tube 52. When outer tube 52 moves upwardly a bracket 84 at the bottom of the tube 52 of the stabilizer moves upwardly into a latching relationship with a member 85 extending downwardly from the frame 15 of the machine; this secures the bottom of the stabilizer firmly in place. FIG. 10 shows the member 85 extending downwardly from frame 15 and bracket 84 extending inwardly from tube 52.

When the boss 73, the bracket 85 and hydraulic hoses 67 and 69 are in place on vehicle 11, only three steps are required to install the stabilizer 10 of this invention on the vehicle. The first is to hang the stabilizer 10 on the boss 73. The second is to operate nut 74 to secure the upper connection, which also secures the bottom connection. The third step is to attach two hydraulic hoses 66 and 68 which are parts of the stabilizer to the hoses 67 and 69 on the vehicle. Removing the stabilizer requires the same three steps carried out in reverse order.

Figure 11:
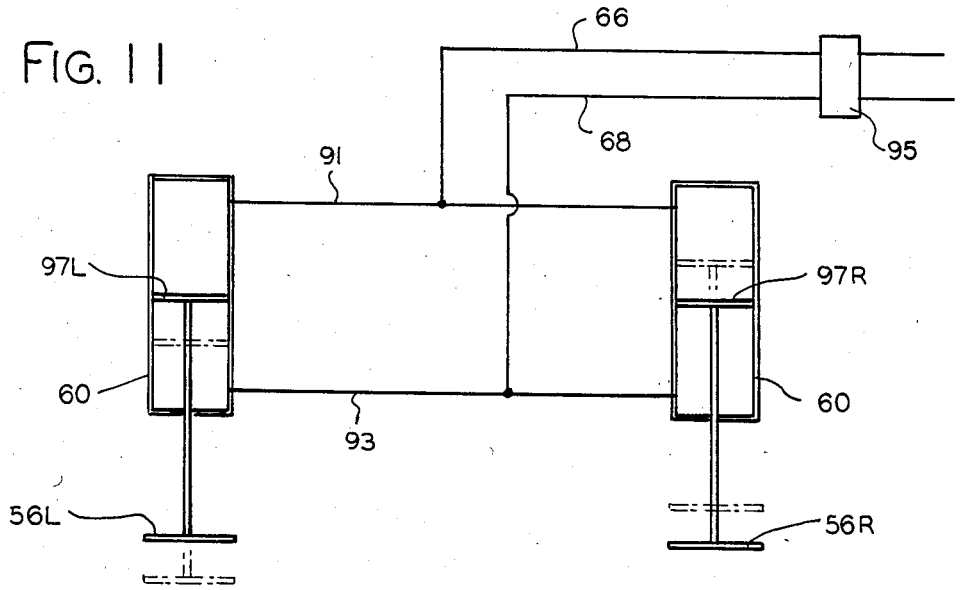
FIG. 11 shows the hydraulic circuit for two of the stabilizers.

When two of these stabilizers are used together they may be connected hydraulically as shown in FIG. 11 to not only enhance the down pressure exerted on an implement at the other end of the vehicle and the braking effort but in addition to compensate for uneven terrain. In FIG. 11 the two stabilizer cylinders 60 are connected so that a hydraulic conduit 91 joins the head ends of the cylinders and a hydraulic conduit 93 joins the rod ends of the cylinders. Conduit 66 is connected between conduit 91 and a two-way control valve 95. Conduit 68 is connected between conduit 93 and control valve 95. When valve the 95 is operated to pressurize conduit 91 and thus the head ends of the two cylinders, while pressure is released from conduit 93, the two stabilizers will be extended until they reach the end of their travel or the control valve is returned to neutral. This procedure discharges hydraulic fluid from the rod ends of the two cylinders through conduits 93 and 68. The control valve 95 can be operated in the opposite sense to pressurize conduits 68 and 93 while relieving the pressure in conduits 91 and 66, thus causing the stabilizer cylinders to retract.

As shown diagrammatically in FIG. 11 the pistons of the two cylinders are indicated at 97L and 97R. If the stabilizers are on uneven ground the hydraulic circuit provides for fluid to flow from the head end of one of the cylinders to the head end of the other through conduit 91, with similar flow in the other direction through conduit 93 from one of the rod ends to the other rod end. The result of the ground being uneven may be the positioning of the pistons 97L and 97R in the position indicated by the dashed lines in FIG. 11. Other dashed lines show the manner in which the bases 56L and 56R of the stabilizers move in unison with the pistons, 56L moving downwardly and 56R moving upwardly an equal amount. There is a flow of hydraulic fluid in the loop which comprises conduits 91 and 93 and the chambers of the cylinders 60 which causes the stabilizer of this invention to adjust to uneven terrain.

While we have described and illustrated herein a preferred embodiment of our invention which is also the best mode contemplated for using it, it will be appreciated that modifications and alterations may be made. Accordingly, it should be understood that we intend to cover by the appended claims all such modifications which fall within the true spirit and scope of our invention. "Hydraulic cylinder" or "cylinder" alone as used herein means a double acting linear hydraulic motor comprising an outer barrel portion with both ends closed and an internal piston forming variable volume chambers between the piston and the respective ends of the barrel portion; the piston is mounted on a rod which projects through the closure at one end of the barrel portion. While reference is made herein to hydraulic hoses it will be appreciated that other equivalent hydraulic conduits can be utilized in the present invention.

We claim:

1. A stabilizer attachment for a vehicle which has an upper frame portion having an outwardly projecting boss thereon, a lower frame portion having a projecting latch member thereon, and hoses from a source of pressurized hydraulic fluid, comprising an elongated telescopic structure comprising an outer tube and an inner tube, a hanger member secured near the top of said outer tube and adapted to be hung on said boss, a latching mechanism including said hanger member for securely latching said outer tube to said upper frame portion, a bracket secured near the bottom of said outer tube which interacts with said projecting latch member for securing said bottom portion of said tube to said lower frame portion when said latching mechanism latches said outer tube to said boss and upper frame portion, and hydraulic hoses forming a part of the stabilizer attachment which are adapted to be connected to the first said hoses respectively.

2. A stabilizer attachment as in claim 1 wherein said telescopic structure includes an internal hydraulic cylinder.

3. A stabilizer attachment as in claim 2 wherein said hydraulic cylinder is double acting.

4. A stabilizer attachment for a vehicle as in claim 1 which is attachable to one side of the vehicle, wherein another attachment which is the mirror image of the first attachment is attachable to frame portions on the other side of the vehicle.

5. A stabilizer for a vehicle, comprising an outer tubular member arranged to be attached to said vehicle in vertically disposed relation, and an inner tubular member arranged for reciprocal movement inside said outer tubular member, a hydraulic cylinder within said inner tubular member for moving said inner member reciprocally, a latching mechanism adjacent the upper end of said outer tubular member for latching said stabilizer attachment to said frame when the stabilizer attachment is installed on the vehicle, said latch mechanism including means for moving said outer tubular member axially to secure said attachment to said frame, and an interengaging mechanism adjacent the other end of said outer tubular member for securing said other end of said outer tubular member to said frame when said latch mechanism is operated.

6. A stabilizer as in claim 5 wherein said latch mechanism includes a hanger member for initially hanging said attachment on said vehicle.

7. A method of installing a linear hydraulically operated variable length stabilizer attachment on a vehicle frame which has an upper portion and a lower portion, a horizontally projecting boss on said upper portion, a projecting latch member on said lower portion, and mating portions on said variable length stabilizer for interacting with said boss and said latch member respectively, comprising hanging said stabilizer attachment on said boss, tightening a bolt clamping the attachment securely to said boss and said upper portion of said frame, and connecting at least one hydraulic hose on said attachment to a hydraulic hose on said vehicle.

8. A method as in claim 7 which includes interengaging a bracket on said attachment near the bottom with said projecting latch member when said attachment is secured to said boss.

9. A vehicle stabilizer apparatus, comprising a pair of outer tubular members attached to the opposite sides of the vehicle in vertically disposed relation, a pair of inner tubular members arranged for reciprocal movement inside said outer tubular members respectively, a pair of hydraulic cylinders within said inner tubular members respectively for moving said inner members reciprocally, a pair of latching mechanisms adjacent the upper end of said outer tubular members for securing said outer tubular members respectively to said vehicle to install them on the vehicle, a pair of interengaging mechanisms adjacent the other ends of said outer tubular members respectively for securing said other ends of said outer tubular member to said frame when said upper ends are secured, a first conduit interconnecting the head ends of said hydraulic cylinders, a second conduit interconnecting the rod ends of said hydraulic cylinders, a two-way valve having a neutral position and two other positions, one of which is to pressurize the conduit connecting the two head ends and the other of which is to pressurize the conduit connecting the two rod ends, whereby when said valve is in the neutral position hydraulic fluid can flow through the said two conduits in opposite directions to adapt the stabilizer apparatus to uneven terrain.

10. A vehicle stabilizer apparatus as in claim 9 wherein said outer tubular members are movable axially to secure both said upper ends and said other ends respectively to said vehicle.

* * * * *